United States Patent [19]

Caluscos

[11] 3,987,935

[45] Oct. 26, 1976

[54] PERFUME DISPENSER

[75] Inventor: Raphael P. Caluscos, Newark, N.J.

[73] Assignee: The Raymond Lee Organization, Inc., New York, N.Y.

[22] Filed: Nov. 17, 1975

[21] Appl. No.: 632,489

[52] U.S. Cl. ..... 222/173; 222/509; 239/289

[51] Int. Cl.[2] ..... B05B 15/00

[58] Field of Search ..... 239/273, 274, 282, 283, 239/285, 289, 579; 222/130, 173, 509; 206/44.11, 526, 527; 128/173 R

[56] References Cited

UNITED STATES PATENTS

| | | | |
|---|---|---|---|
| 2,795,799 | 6/1957 | Dickerman | 239/274 X |
| 3,150,800 | 9/1964 | Weber | 222/509 X |
| 3,179,292 | 4/1965 | Terry | 222/130 X |
| 3,286,883 | 11/1966 | Takiff | 239/274 X |
| 3,420,445 | 1/1969 | Inzerill | 239/274 |

*Primary Examiner*—Evon C. Blunk
*Assistant Examiner*—Andres Kashnikow
*Attorney, Agent, or Firm*—Stephen Wyden

[57] ABSTRACT

A housing containing a lever arm operated by a spring loaded button causing pressure on a nozzle of a pressurized perfume container causes spraying of perfume through a slightly depressed opening in the housing into the palm of the hand of the woman pressing the button.

1 Claim, 6 Drawing Figures

PERFUME DISPENSER

I have invented a new and novel perfume dispenser. My perfume dispenser will permit a user to perfume the palm of her hand using only that hand. This will allow greater convenience in dispensing the perfume and provide a note of elegance in the application of the perfume to the hand compared to previous perfume dispensers which required one hand to dispense the perfume for application on the other hand.

My invention can be understood in view of the accompanying figures.

Figure 1:
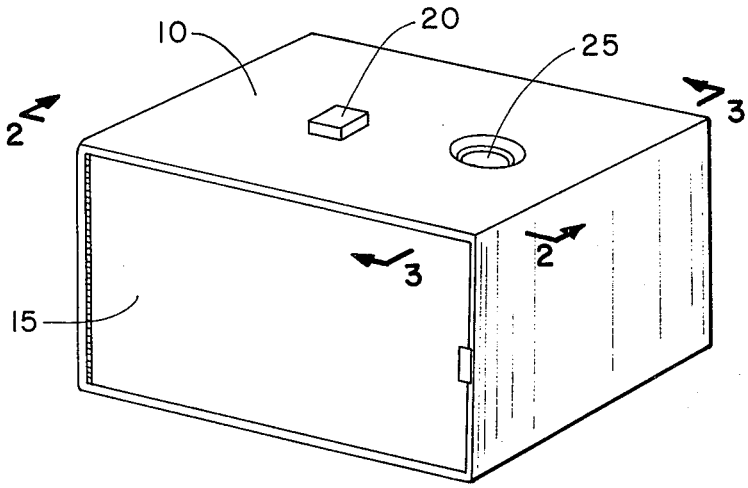
FIG. 1 shows the dispenser in perspective.

In FIG. 1, the dispenser housing 10 has a hinged front door 15 for inserting pressurized perfume containers, a button to press 20 to cause the perfume to be dispensed through a slightly depressed opening 25.

Figure 2:
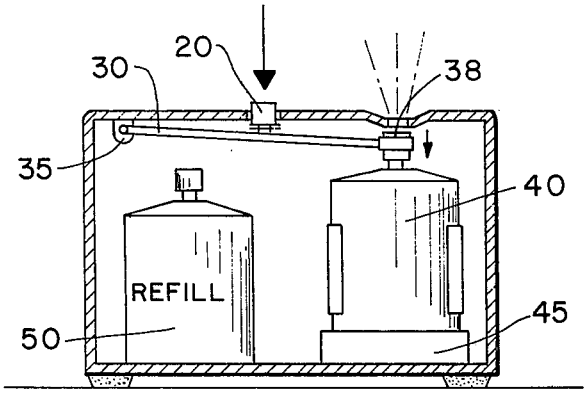
FIG. 2 is a section of FIG. 1 taken in the plane 2—2.

In FIG. 2, the button 20, when pressed on, presses on a lever 30 which is pivotally attached 35 to the top of the housing 10 and presses, at its distal end, on the nozzle 38 of a pressurized perfume container 40 resting on an internal support stand 45. A refill pressurized perfume container 50 can be stored in the housing 10.

Figure 3:
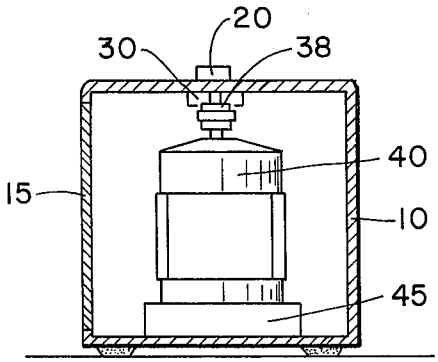
FIG. 3 is a section of FIG. 1 taken in the plane 3—3.

In FIG. 3 can be seen the perfume container 40, the nozzle 38, the lever arm 30, and the button 20, the internal support stand 45, all housed in the housing 10, and the front door 15.

Figure 4:
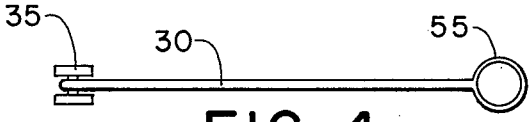
FIG. 4 is a detailed view of the lever arm.

In FIG. 4, the lever arm 30 is pivotally attached 35 at one end to the housing, as seen in FIG. 2, and forms a loop 55 at the distal end to attach to and press on the nozzle 38 of a pressurized perfume container 40, as seen in FIG. 2.

Figure 5:
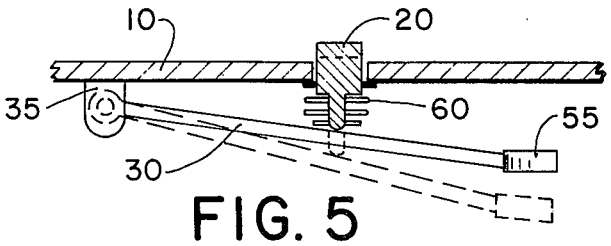
FIG. 5 is a detailed view of the action of the dispensing button on the lever arm.

In FIG. 5, the housing 10 supports, pivotally 35 the lever arm 30 permitting the spring loaded 60 button 20 to press on the arm 30 causing the loop 55 to move down on the nozzle 38, as seen in FIG. 2.

Figure 6:
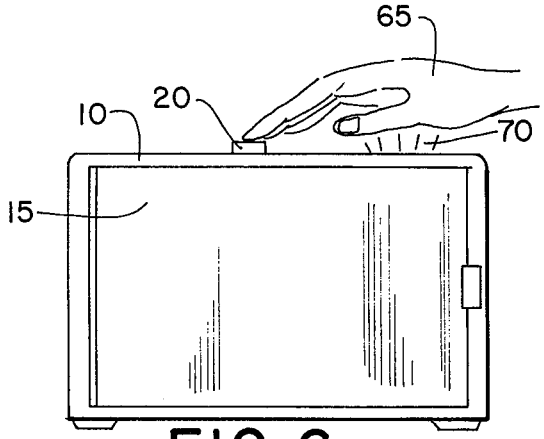
FIG. 6 shows a front view of the dispenser in use.

In FIG. 6, a woman is pressing her hand 65 on the button 20 at the top of the housing 10 and is receiving a spray of perfume 70 on the palm of her hand 65. The front door 15 is visible in this view.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A perfume dispenser, comprising:

a housing, a lever arm pivotally attached to the housing, a spring loaded button attached to and passing through the housing to press on the lever arm, a distal end of the lever arm forming a loop, an internal support stand mounted in the housing, a pressurized perfume container mounted on the stand, a nozzle attached to the top of the container for dispensing the perfume, the housing forming a slightly depressed opening over the nozzle, the loop of the lever arm removably insertable over the nozzle, whereby pressing on the button causes the pivotal movement of the lever arm thereby pressing on the nozzle causing the release of the perfume through the opening, and means of inserting and removing the perfume container and a refill container into and from the housing.

* * * * *